US010094328B2

(12) United States Patent
Elie et al.

(10) Patent No.: US 10,094,328 B2
(45) Date of Patent: Oct. 9, 2018

(54) FORMING ASSEMBLY AND METHOD TO PROVIDE A COMPONENT WITH A PASSAGEWAY

(71) Applicant: Ford Global Technologies, LLC, Dearborn, MI (US)

(72) Inventors: Larry Dean Elie, Ypsilanti, MI (US); Timothy J. Potter, Dearborn, MI (US); Clifford E. Maki, New Hudson, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 257 days.

(21) Appl. No.: 15/217,153

(22) Filed: Jul. 22, 2016

(65) Prior Publication Data

US 2018/0023507 A1 Jan. 25, 2018

(51) Int. Cl.

| | |
|---|---|
| ***B22D 29/00*** | (2006.01) |
| ***B22C 9/10*** | (2006.01) |
| ***F02F 7/00*** | (2006.01) |
| ***B22D 27/04*** | (2006.01) |
| ***B22C 9/06*** | (2006.01) |

(52) U.S. Cl.

CPC ..... *F02F 7/007* (2013.01); *B22C 9/06* (2013.01); *B22C 9/101* (2013.01); *B22D 27/04* (2013.01); *B22D 29/001* (2013.01); *F02F 7/0085* (2013.01); *F02F 7/0095* (2013.01); *F02F 2200/06* (2013.01)

(58) Field of Classification Search

CPC ..... B22C 9/101; B22D 15/02; B22D 25/02; B22D 29/001

USPC ..... 164/132

See application file for complete search history.

(56) References Cited

U.S. PATENT DOCUMENTS

| | | | | |
|---|---|---|---|---|
| 4,693,294 | A | 9/1987 | Albrecht et al. | |
| 5,217,059 | A | 6/1993 | Kuhn et al. | |
| 5,435,960 | A * | 7/1995 | Bressler | B29C 33/3842 164/132 |
| 6,205,959 | B1 | 3/2001 | Smetan et al. | |
| 6,776,127 | B2 * | 8/2004 | Osman | F02F 1/14 123/41.72 |
| 8,191,529 | B2 | 6/2012 | Moss et al. | |
| 8,960,137 | B2 | 2/2015 | Brewer et al. | |

(Continued)

FOREIGN PATENT DOCUMENTS

WO 2011006651 1/2011

*Primary Examiner* — Kevin E Yoon

(74) *Attorney, Agent, or Firm* — Carlson, Gaskey & Olds, P.C.

(57) ABSTRACT

An exemplary forming assembly includes a mold having a cavity to form a component, and an insert having first, second, and third regions. The first region provides a first passageway opening in the component. The second region provides a second passageway opening in the component. The third region provides a passageway in the component. The insert is rotatable from a first position within the passageway to a second position outside the passageway. An exemplary component forming method includes positioning a material around an insert, curing the material to provide a component, and rotating the insert relative to the component from a first position where at least some of the insert is received within a passageway of the component to a second position where the entire insert is outside the passageway.

20 Claims, 5 Drawing Sheets

(56) References Cited

U.S. PATENT DOCUMENTS

2002/0157801 A1* 10/2002 Maeyama ..... B22D 17/24
164/113
2008/0000610 A1* 1/2008 Bunker ..... B22C 9/10
164/132

* cited by examiner

FORMING ASSEMBLY AND METHOD TO PROVIDE A COMPONENT WITH A PASSAGEWAY

TECHNICAL FIELD

This disclosure relates generally to a component with a passageway. More particularly, the disclosure relates to forming the component about an insert. The insert is then rotated out of the component to provide the passageway.

BACKGROUND

Engine blocks and other components can include one or more passageways. Some of the passageways can communicate a coolant. Moving the coolant through such passageways carries thermal energy from the engine block to cool the engine block. Sensors can be mounted within some passageways. Wiring can be routed through some passageways.

Machining passageways in some areas of the engine block can be difficult, such as the areas between adjacent cylinders. In the past, machining processes, such as saw-cutting or cross-drilling, have been utilized to machine passageways into these and other areas. Machining passageways can increase production time, and the geometries of passageways created by machining are limited.

SUMMARY

A forming assembly according to an exemplary aspect of the present disclosure includes a mold having a cavity to form a component, and an insert having first, second, and third regions. The first region provides a first passageway opening in the component. The second region provides a second passageway opening in the component. The third region provides a passageway in the component. The insert is rotatable from a first position within the passageway to a second position outside the passageway.

In a further non-limiting embodiment of the foregoing assembly, the insert is rotatable from the first position to the second position through the first passageway opening.

In a further non-limiting embodiment of any of the foregoing assemblies, the third region extends from the first region to the second region.

In a further non-limiting embodiment of any of the foregoing assemblies, the third region has an arc-shaped profile.

In a further non-limiting embodiment of any of the foregoing assemblies, the first region has a cross-sectional area that is greater than a cross-sectional area of the second region, and the third region of the insert decreasingly tapers from the first region to the second region.

In a further non-limiting embodiment of any of the foregoing assemblies, the passageway is a coolant passageway.

In a further non-limiting embodiment of any of the foregoing assemblies, the first region is a first contact face of the insert that is configured to directly contact the mold, and the second region is a second contact face of the insert that is configured to directly contact the mold.

In a further non-limiting embodiment of any of the foregoing assemblies, the component is an engine block and the insert is positioned between a first cylinder and a second cylinder of the engine block when the insert is in the first position.

In a further non-limiting embodiment of any of the foregoing assemblies, the first cylinder, the second cylinder, the first opening, and the second opening, all open to a common surface of the engine block.

In a further non-limiting embodiment of any of the foregoing assemblies, the component is aluminum and the insert comprises a material other than aluminum.

An component forming method according to an exemplary aspect of the present disclosure includes, among other things, positioning a material around an insert, curing the material to provide a component, and rotating the insert relative to the component from a first position where at least some of the insert is received within a passageway of the component to a second position where the entire insert is outside the passageway.

In a further non-limiting embodiment of the foregoing method, the insert is within a mold cavity during the surrounding.

In a further non-limiting embodiment of any of the foregoing methods, the passageway extends from a first opening to a second opening, and the insert is moved through the first opening during the rotating.

In a further non-limiting embodiment of any of the foregoing methods, the first opening has a cross-sectional area that is greater than a cross-sectional area of the second opening, and the passageway decreasingly tapers from the first opening to the second opening.

In a further non-limiting embodiment of any of the foregoing methods, the passageway is distributed annularly from the first opening to the second opening.

A further non-limiting embodiment of any of the foregoing methods includes rotating the insert relative to the component no more than 180 degrees about an axis to move the insert from the first position to the second position.

A further non-limiting embodiment of any of the foregoing methods includes positioning a first region of the insert against a mold during the curing to provide the first opening, and positioning a second region of the insert against the mold during the curing to provide the second opening.

In a further non-limiting embodiment of any of the foregoing methods, the passageway has a rectangular cross-sectional profile.

A further non-limiting embodiment of any of the foregoing methods includes communicating a coolant through the passageway when the insert is in the second position, and cooling the component using the coolant. The component is an engine block.

A further non-limiting embodiment of any of the foregoing methods includes shrinking the material away from the insert during the curing.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a formed component, such as an engine block, having a passageway. To establish the passageway, a material is positioned about an insert. The material cures to provide the component, and the insert is then rotated out of the component to provide the passageway. In some examples, the passageway is a coolant passageway located between adjacent cylinders of an engine block.

Figure 1:
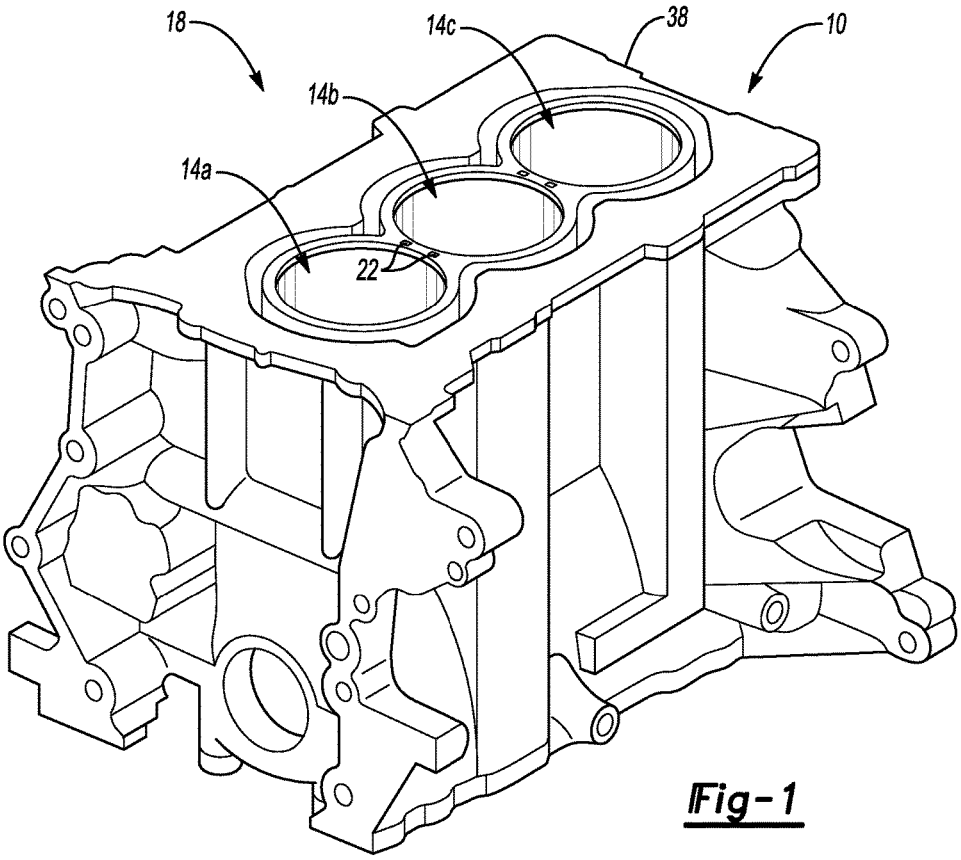
FIG. 1 illustrates a perspective view of an example engine block.

Referring to FIG. 1, an example engine block 10 for an engine of a vehicle includes three cylinders 14*a*, 14*b*, and 14*c*. Although described in connection with an engine block 10, the teachings of this disclosure could be used in connection with other components having passageways, such as engine heads, intake manifolds, front covers. The components generally include any structure having flow though a flange structure.

An area 18 represents an area of the engine block 10 between the cylinders 14*a* and 14*b*. Packaging and weight requirements for the engine block 10 can necessitate placing the cylinders 14*a*, 14*b*, and 14*c* closer together, which can reduce the size of the area 18 relative to other engine blocks.

As the engine operates within the vehicle, thermal energy levels in the engine block 10 can increase. The engine block 10 is cooled to reduce the thermal energy levels. During cooling, a coolant, such as water, is moved through various coolant passageways within the engine block 10 to carry thermal energy from the engine block 10.

The area 18 can include high levels of thermal energy if not cooled. The area 18 thus includes at least one coolant passageway 22. Complex machining processes are not used to create the coolant passageway 22 in the engine block 10 after the engine block 10 is formed. Instead, the coolant passageway 22 is formed with the engine block 10.

Some other areas of the engine block 10 could include coolant passageways that are machined into the engine block 10. Machining process may not be able to replicate a desired geometry of the coolant passageway 22. Even if machining processes could produce the coolant passageway 22, those machining process could be complex and could substantially increase production time. Forming the coolant passageway 22 when forming the engine block 10 can avoid the drawbacks associated with complex machining processes. In this example, even secondary machining operations may not be required to create the coolant passageway 22.

In one non-limiting embodiment, the example engine block 10 is cast from an aluminum material during a high pressure aluminum die casting forming process. In other examples, the engine block 10 is formed from other materials and formed by other forming processes. Thus, the engine block 10 is not limited to engine blocks formed from aluminum.

For example, the engine block 10 could instead be cast from a steel material during a steel die casting forming process, or the engine block 10 could be a polymer material that is molded during an injection molding forming process. The engine block 10 could also be a cast iron or magnesium material. The molds for casting or injection molding the engine block 10 could be permanent or semi-permanent molds.

Figure 2:
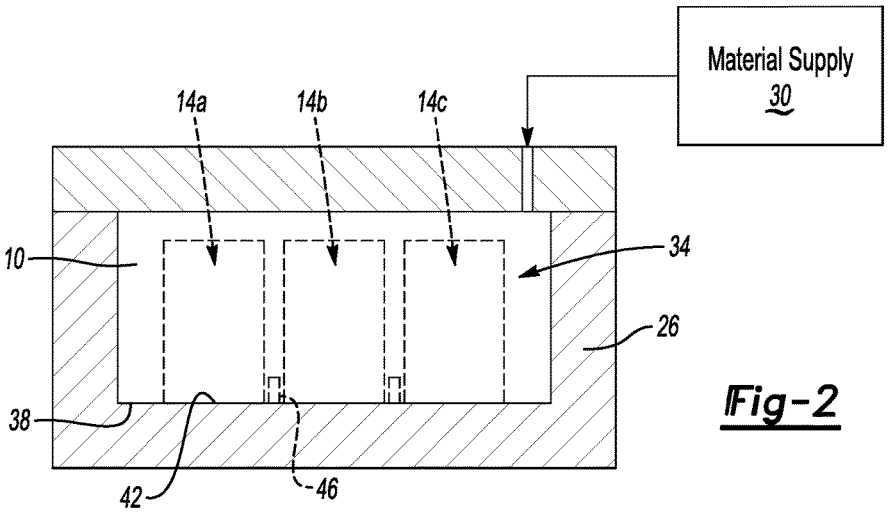
FIG. 2 illustrates a highly schematic view of a forming assembly to manufacture the engine block of FIG. 1.
Figure 3:
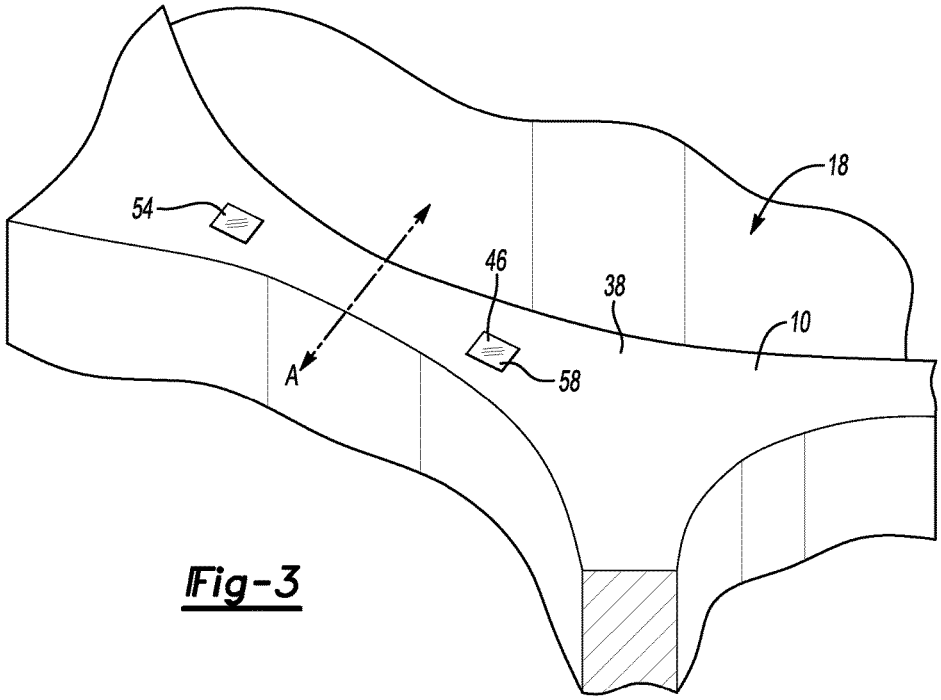
FIG. 3 illustrates a close-up view of a portion of the engine block of FIG. 1 showing an insert received within a passageway.
Figure 4:
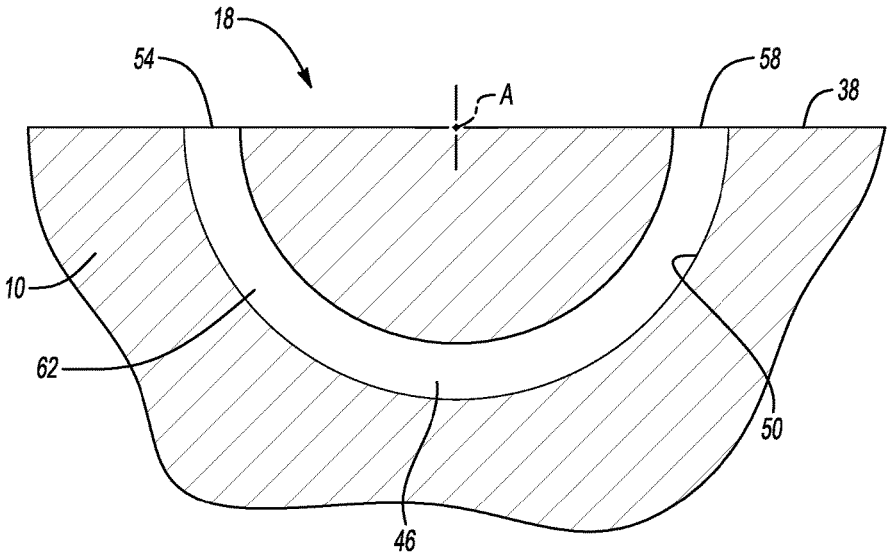
FIG. 4 illustrates a partially sectioned side view of FIG. 3.

Referring now to FIGS. 2-4 with continuing reference to FIG. 1, the engine block 10 is formed within a mold 26. During the forming, material from a material supply 30 is added to a cavity 34 of the mold 26. The material cures within the cavity 34 of the mold 26 to provide the engine block 10. Within the cavity 34 of the mold 26, a surface 38 of the engine block 10 is in contact with a surface 42 of the mold 26. The cylinders 14*a*, 14*b*, and 14*c* all open to the surface 38 of the engine block 10.

Prior to fully curing, the material flows around an insert 46 within the cavity 34. The material then cures and holds the position of the insert 46 within the engine block 10. The insert 46 is then removed from the mold 26 to provide a passageway 50 within the area 18. The passageway 50 represents the portion of the cavity 34 occupied by the insert 46 within the mold 26.

During operation of the engine having the engine block 10, coolant can be communicated through the passageway 50 to cool the area 18. Various types of coolant could be circulated through the passageway 50 to cool the engine block 10 during operation. Examples of coolant include oil, water, or antifreeze. In another example, the passageway 50 can hold a sensor, a wiring, or some other component. A person having skill in this art and the benefit of this disclosure would understand how to communicate coolant through a passageway, or how to house a component within a passageway.

When forming the engine block 10 within the mold 26, a first region 54 of the insert 46 is positioned against the surface 42 of the mold 26 during casting, and a second region 58 of the insert 46 is also positioned against the surface 42 of the mold 26. The first region 54 and second region 58 are each considered mold contact faces in this example since the first region 54 and the second region 58 are configured to be positioned against the surface 42 of the mold.

Positioning the first region 54 and the second region 58 against surface 42 blocks material from flowing between the surface 42 of the mold 26 and the first region 54, and from flowing between the surface of the mold 26 and the second region 58.

In this example, the first region 54 and the second region 58 are positioned against a common surface of the mold 26 when the engine block 10 is formed. In another example, the first region 54 is positioned against a first surface of the mold 26, and the second region 58 is positioned against a second surface of the mold 26 that is separate and distinct from the first surface.

During forming of the engine block 10, the insert 46 could be held in position within the cavity 34 with a wire frame.

In another example, the engine block 10 is cast utilizing a lost foam forming process where foam mimicking the engine block 10 holds the insert 46 within the cavity 34. Material is then added to the cavity 34 from the material supply 30. The material melts away the foam while the insert 46 maintains its position within the cavity 34. The material then cures into the engine block 10.

In addition to the first region 54 and the second region 58, the insert 46 includes a third region 62 extending from the first region 54 to the second region 58. In this example, the insert 46 extends circumferentially 180 degrees about an axis A that extends out of the page in FIG. 4. The insert 46, and thus the passageway 50, have an arc-shaped profile. Since the example insert 46 is distributed annularly about the axis A and extends circumferentially 180 degrees about the axis A, the example insert 46 has a hemispherical shape. Other example inserts could extend about the axis 120 degrees, 90 degrees, or some other distance. Typically, the other example inserts would extend no more than 180 degrees.

The material and geometry of the insert 46 is selected, at least in part, according to the material from the material supply 30 that is used to form the engine block 10. The material of the insert 46 can be a combination of several materials, as can the material of the engine block 10. If, as here, the engine block 10 is an aluminum, a material for the insert 46 is selected that will not bond to the aluminum. If the engine block 10 is formed of nonaluminum material, such as cast iron, magnesium, or a polymer, the material of the insert 46 is selected that will not bond to the nonaluminum material. Whether or not the material of the insert 46 will bonds to the material of the engine block 10 can depend on temperatures reached during forming. For example, some material will not bond at lower temperatures, but bond at higher temperatures. Thus, the temperatures reached during forming can influence the material and geometry selected for the insert 46. High temperature mold release compounds also can influence the selection of material for the insert, and geometry of the insert.

Selecting a material for the insert 46 that does not substantially bond or wet to the material of the engine block 10 facilitates removing the insert 46 to provide the passageway 50. In this example, the insert 46 is not substantially bonded to the engine block 10 and can be rotated about the axis A to remove the insert 46 from the engine block 10 and provide the passageway 50.

Figure 5:
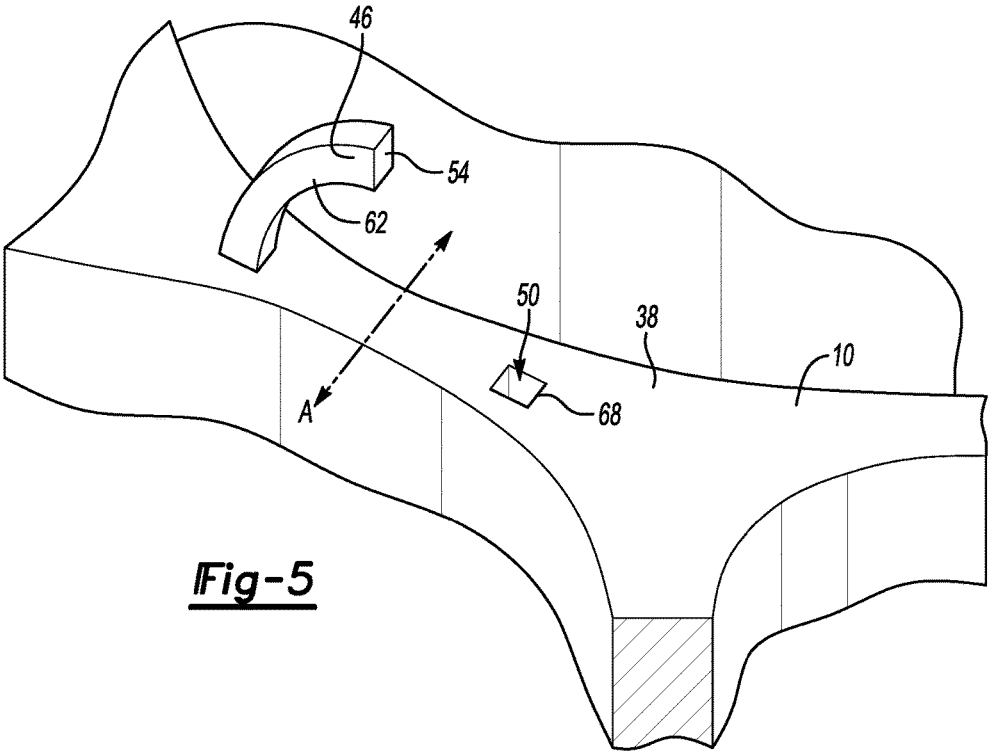
FIG. 5 illustrates a close-up view of the portion of the engine block of FIG. 1 showing the insert rotated from the position of FIGS. 3 and 4.
Figure 6:
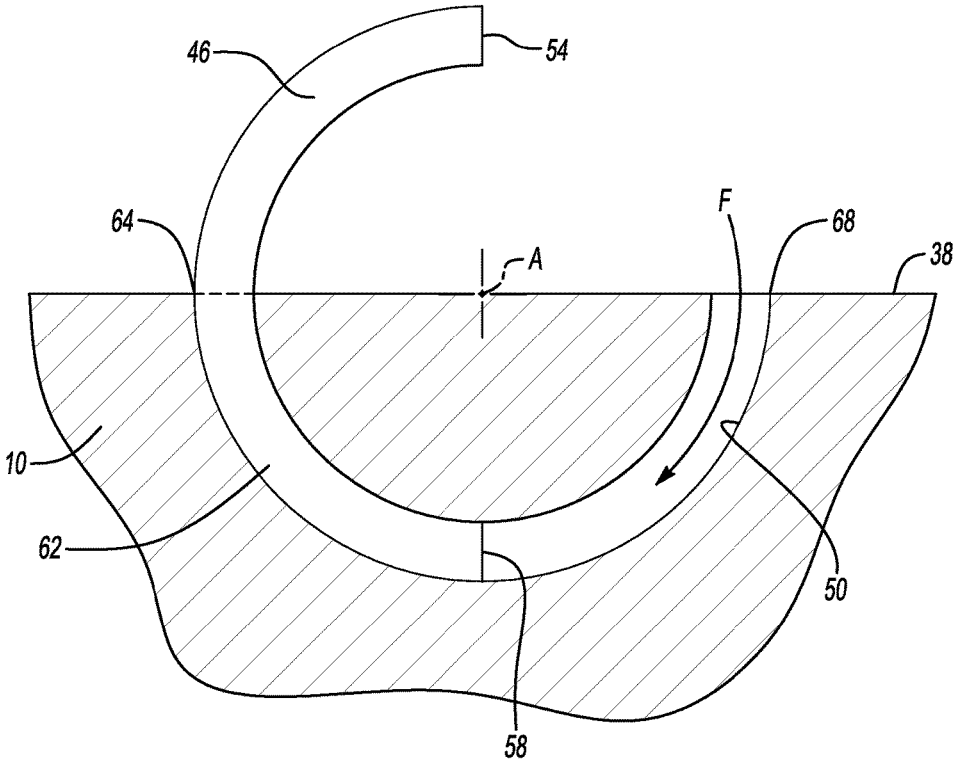
FIG. 6 illustrates a partially sectioned side view of FIG. 5.

Referring now to FIGS. 5 and 6, the insert 46 is shown being partially removed from the engine block 10. To move the insert 46 from the position of FIGS. 3 and 4 to the position of FIGS. 5 and 6, a force F is applied to the second region 58 to push the insert 46 out of the passageway 50. Applying the force F to the second region 58 rotates the inert 46 in a clockwise direction about the axis A. In another example, the force F could be applied to the first region 54 to rotate the insert in a counterclockwise direction about the axis and out of the passageway 50.

In some examples, a slide (not shown) is actuated to push the insert 46. In another example, an operator uses their hand or a tool to push the insert 46 to the position of FIGS. 5 and 6.

Figure 7:
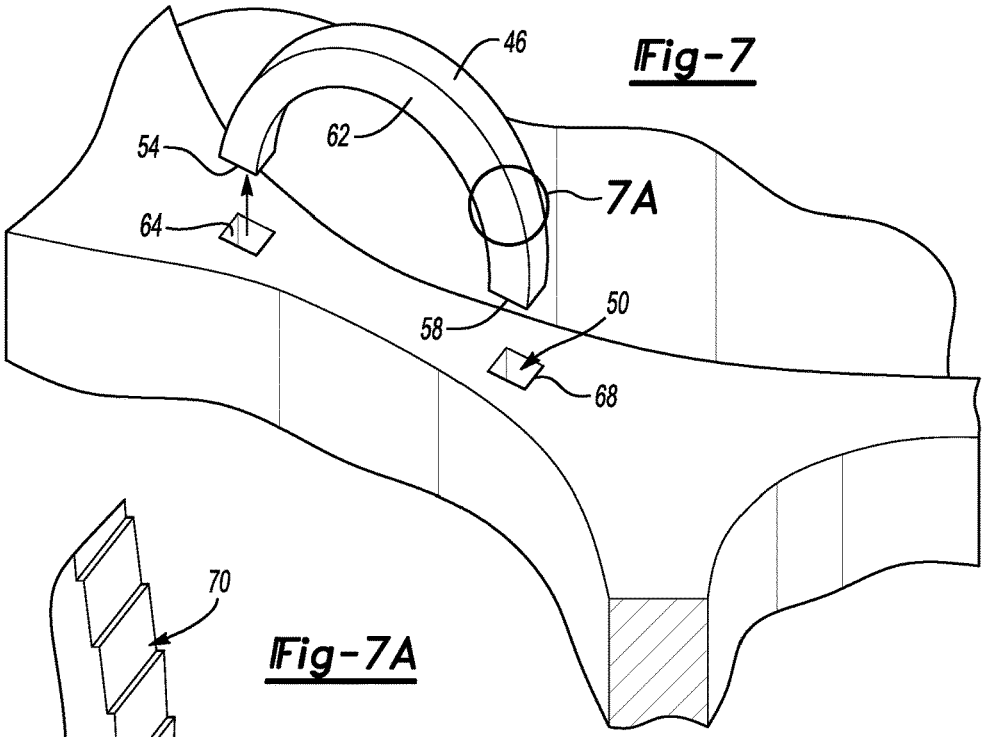
FIG. 7 illustrates a close-up view of the portion of the engine block of FIG. 1 showing the insert rotated from the position of FIGS. 5 and 6.
Figure 8:
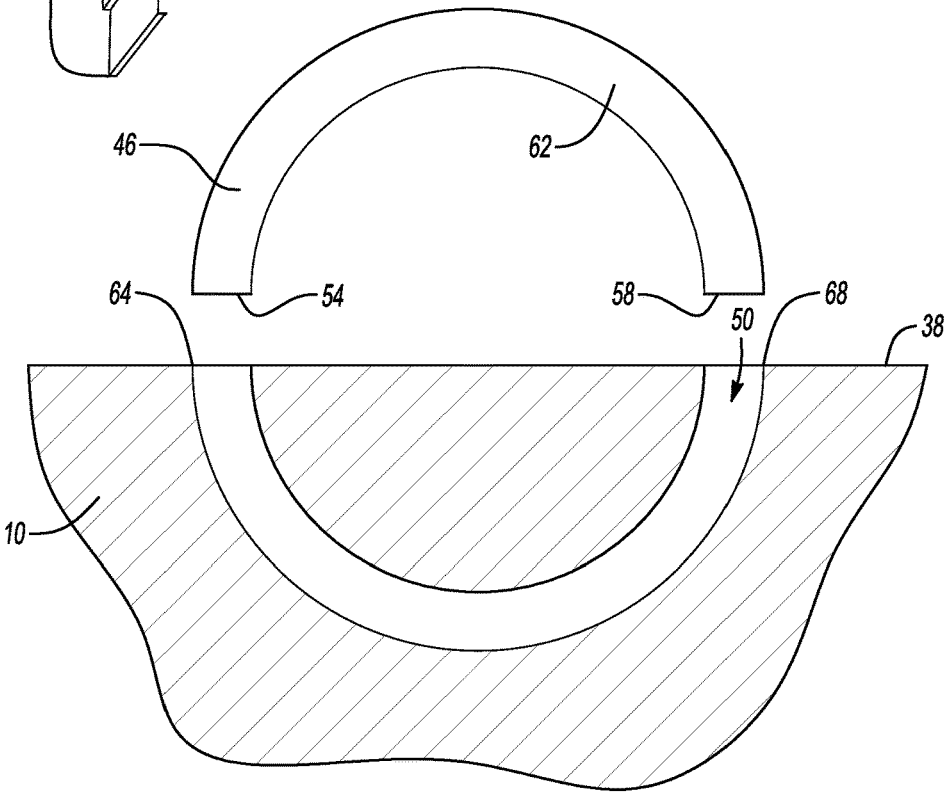
FIG. 8 illustrates a partially sectioned side view of FIG. 7.

Referring now to FIGS. 7-8, the force continues to press on the second region 58 until the insert 46 has been rotated about the axis A to a position where the insert 46 is fully outside the passageway 50. Alternatively, the portion of the insert 46 that has been pushed outside the passageway 50 could instead, or additionally, be pulled by a tool, actuator, or the operator to remove the insert 46 from the passageway 50.

In some examples, the insert 46 is moved fully outside the passageway 50 while the engine block 10 is within the cavity 34 (FIG. 2.) The insert 46 could, for example, move into a recess within the mold 26.

In this example, the first region 54 of the insert 46 provides a first passageway opening 64 in the engine block 10. Further, the second region 58 of the insert 46 provides a second passageway opening 68 in the engine block 10. The insert 46 is rotated such that the insert 46 moves through the second passageway opening 68 to a position where the insert 46 is fully outside the passageway 50. Because the insert 46 does not extend more than 180 degrees about the axis, the second region 58 is not entering the first passageway opening 64 as the first region 54 passes through the second passageway opening 68.

In some examples, the first region 54 has a cross-sectional area that is greater than a cross-sectional area of the second region 58. In such examples, the third region 62 of the insert 46 can taper downwardly from the larger cross-section of the first region 54 to the smaller cross-section of the second region 58. The tapering facilitates moving the insert 46 through the first passageway opening 64 to the position of FIGS. 7 and 8 to remove the insert 46 from the engine block 10.

Tapering the insert 46 provides a taper to the passageway 50 such that the first passageway opening 64 is larger than the second passageway opening 68. The tapering of the passageway 50 can be in response to a preferred direction and velocity of coolant flow through the passageway 50, or a desired pressure drop as the coolant moves through the passageway 50. In some examples, tapering the passageway 50 can provide momentum to the coolant moving from the passageway 50, which can improve coolant distribution adjacent the cylinders 14*a*, 14*b* (FIG. 1), for example. To provide such momentum to the coolant, the coolant can move through the passageway 50 from the second passageway opening 68 to the larger, first passageway opening 64.

In this example, the passageway 50 and the insert 46 have a rectangular cross-sectional profile. In another example, the cross-sectional profiles could be round, elliptical, or some other profile. Cross-sections could be selected based on a rate of cooling. For example, cross-sections that are not round could, in some examples, cool faster than cross-sections that are round. If a faster cooling rate is desired, the cross-section that is not round could be used.

Figure 7A:
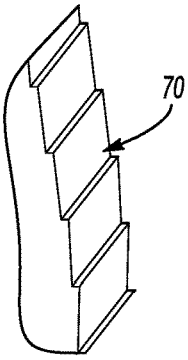
FIG. 7A illustrates a close-up view of another example insert for use in connection with the engine block of FIGS. 1-7.

In some examples, the insert 46 could include features on its outwardly facing surface such as steps 70 (FIG. 7A). Since the engine block 10 is cast about the steps 70, the engine block 10 would include corresponding steps on the surfaces of the passageway 50 once the insert 46 is removed. The steps within the passageway 50 could be incorporated to disrupt, or otherwise redirect, cooling flow through the passageway 50. The disrupted flow may cause the coolant to be more turbulent, which can promote transfer of thermal energy from the engine block 10 to the coolant. The steps 70 taper toward the second passageway opening 68 so that the steps 70 do not prevent the insert 46 with the steps 70 from moving through the second passageway opening.

Figure 9:
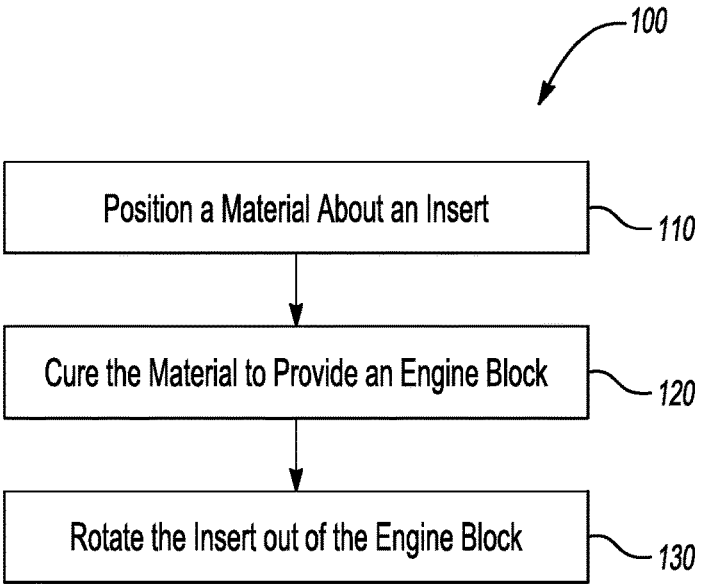
FIG. 9 illustrates the flow of an example method of forming a passageway in an engine block.

Referring to FIG. 9, an exemplary engine block forming method 100 provides an engine block with a passageway that can be used to communicate a coolant, house a component, or for some other purpose. The method 100 starts at a step 110 where material is positioned about an insert. The material could be positioned during a high pressure die casting or an injection molding process. The material cures at a step 120. The cured material is an engine block. Next, at a step 130, the insert is rotated out of the engine block leaving behind a passageway. The insert is rotated relative to the engine block from a position where the insert is at least partially within the passageway to a position where the entire insert is outside the passageway.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A forming assembly, comprising:

a mold having a cavity to form a component; and an insert having a first region to provide a first passageway opening in the component, a second region to provide a second passageway opening in the component, and a third region to provide a passageway in the component, the insert rotatable from a first position within the passageway to a second position outside the passageway.

2. The forming assembly of claim 1, wherein the insert is rotatable from the first position to the second position through the first passageway opening.

3. The forming assembly of claim 1, wherein the third region extends from the first region to the second region.

4. The forming assembly of claim 3, wherein the third region has an arc-shaped profile.

5. The forming assembly of claim 3, wherein the first region has a cross-sectional area that is greater than a cross-sectional area of the second region and the third region of the insert decreasingly tapers from the first region to the second region.

6. The forming assembly of claim 1, wherein the passageway is a coolant passageway.

7. The forming assembly of claim 1, wherein the first region is a first contact face of the insert that is configured to directly contact the mold, and the second region is a second contact face of the insert that is configured to directly contact the mold.

8. The forming assembly of claim 1, wherein the component is an engine block and the insert is positioned between a first cylinder and a second cylinder of the engine block when the insert is in the first position.

9. The forming assembly of claim 8, wherein the first cylinder, the second cylinder, the first opening, and the second opening, all open to a common surface of the engine block.

10. The forming assembly of claim 1, wherein the component is aluminum and the insert comprises a material other than aluminum.

11. A component forming method, comprising:

positioning a material around an insert;

curing the material to provide a component; and rotating the insert relative to the component from a first position where at least some of the insert is received within a passageway of the component to a second position where the entire insert is outside the passageway.

12. The method of claim 11, wherein the insert is within a mold cavity during the surrounding.

13. The method of claim 11, wherein the passageway extends from a first opening to a second opening, and the insert is moved through the first opening during the rotating.

14. The method of claim 13, wherein the first opening has a cross-sectional area that is greater than a cross-sectional area of the second opening, and the passageway decreasingly tapers from the first opening to the second opening.

15. The method of claim 13, wherein the passageway is distributed annularly from the first opening to the second opening.

16. The method of claim 11, further comprising rotating the insert relative to the component no more than 180 degrees about an axis to move the insert from the first position to the second position.

17. The method of claim 11, further comprising positioning a first region of the insert against a mold during the curing to provide the first opening, and positioning a second region of the insert against the mold during the curing to provide the second opening.

18. The method of claim 11, wherein the passageway has a rectangular cross-sectional profile.

19. The method of claim 11, further comprising communicating a coolant through the passageway when the insert is in the second position, and cooling the component using the coolant, wherein the component is an engine block.

20. The method of claim 11, further comprising shrinking the material away from the insert during the curing.

* * * * *